US005707180A

United States Patent [19]

Vickars et al.

[11] Patent Number: 5,707,180

[45] Date of Patent: Jan. 13, 1998

[54] METHOD AND APPARATUS FOR FORMING PILES IN-SITU

[75] Inventors: Robert Alfred Vickars, Burnaby; Jeremiah Charles Tilney Vickars, New Westminster; Gary Toebosch, Surrey, all of Canada

[73] Assignee: Vickars Developments Co. Ltd., Burnaby, Canada

[21] Appl. No.: 577,967

[22] Filed: Dec. 26, 1995

[51] Int. Cl.[6] ..... E02D 5/34; E02D 5/38; E02D 5/74

[52] U.S. Cl. ..... 405/233; 405/237; 405/239; 405/244; 405/248; 405/249

[58] Field of Search ..... 405/233, 239, 405/248, 232, 237, 241, 249, 244

[56] References Cited

U.S. PATENT DOCUMENTS

| | | | |
|---|---|---|---|
| Re. 32,076 | 2/1986 | Dziedzic | 405/303 |
| 2,326,872 | 8/1943 | Marsden | 405/251 |
| 2,412,239 | 12/1946 | Weber | 405/236 |
| 2,926,500 | 3/1960 | Hoppe | 405/253 |
| 3,354,657 | 11/1967 | Turzillo | 405/244 |
| 3,841,032 | 10/1974 | Grannis, III | 52/27 |
| 3,962,879 | 6/1976 | Turzillo | 405/236 |
| 4,239,419 | 12/1980 | Gillen, Jr. | 405/232 |
| 4,334,392 | 6/1982 | Dziedzic | 52/157 |
| 4,405,262 | 9/1983 | Nagashima | 405/221 |
| 4,467,575 | 8/1984 | Dziedzic | 52/157 |
| 4,499,698 | 2/1985 | Hoyt et al. | 52/157 |
| 4,561,231 | 12/1985 | Hoyt et al. | 52/297 |
| 4,678,373 | 7/1987 | Langenbach | 405/230 |
| 4,707,964 | 11/1987 | Hoyt et al. | 52/742 |
| 4,708,530 | 11/1987 | Faber | 405/252 |
| 4,981,000 | 1/1991 | Hamilton et al. | 52/157 |
| 4,996,806 | 3/1991 | Platz | 52/157 |
| 5,011,336 | 4/1991 | Hamilton et al. | 405/230 |
| 5,066,168 | 11/1991 | Holdeman | 405/249 |
| 5,113,626 | 5/1992 | Seider et al. | 52/157 |
| 5,120,163 | 6/1992 | Holdeman et al. | 405/230 |
| 5,139,368 | 8/1992 | Hamilton et al. | 405/230 |
| 5,171,107 | 12/1992 | Hamilton et al. | 405/230 |
| 5,213,448 | 5/1993 | Seider et al. | 405/230 |
| 5,286,142 | 2/1994 | Hoyt et al. | 405/244 |
| 5,573,348 | 11/1996 | Morgan | 405/52 |
| 5,575,593 | 11/1996 | Raaf | 405/233 X |

OTHER PUBLICATIONS

Chance Helical Pier System Brochure © 1995.

*Primary Examiner*—Tamara L. Graysay
*Assistant Examiner*—Tara L. Mayo
*Attorney, Agent, or Firm*—Oyen Wiggs Green & Mutala

[57] ABSTRACT

The invention provides a method for making piles and apparatus for practising the method. The piles may be used to support the foundation of a structure, such as a building. The method draws a soil displacer on a shaft down through a body of soil by turning a screw at the lower end of the shaft. The soil displacer forces soil out of a cylindrical region around the shaft. The cylindrical region is filled with grout to encapsulate and strengthen the shaft. The grout may be fed by gravity from a bath of grout around the shaft. The soil displacer has a diameter smaller than a diameter of the screw and may be a disk extending in a plane generally perpendicular to the shaft.

37 Claims, 6 Drawing Sheets

METHOD AND APPARATUS FOR FORMING PILES IN-SITU

FIELD OF THE INVENTION

This invention relates to a method for making piles and to apparatus for practising the method of the invention. A preferred embodiment of the invention provides a method and apparatus for making piles to support the foundation of a structure, such as a building.

BACKGROUND OF THE INVENTION

Piles are used to support structures, such as buildings, when the soil underlying the structure is too weak to support the structure. There are many techniques that may be used to place a pile. One technique is to cast the pile in place. In this technique, a hole is excavated in the place where the pile is needed and the hole is filled with cement. A problem with this technique is that in weak soils the hole tends to collapse. Therefore, expensive shoring is required. If the hole is more than about 4 to 5 feet deep then safety regulations typically require expensive shoring and other safety precautions to prevent workers from being trapped in the hole.

Turzillo, U.S. Pat. No. 3,962,879 is a modification of this technique. In the Turzillo system a helical auger is used to drill a cylindrical cavity in the earth. The upper end of the auger is held fixed while the auger is rotated about its axis to remove all of the earth from the cylindrical cavity. After the earth has been removed fluid cement water is pumped through the shaft of the auger until the hole is filled with cement. The auger is left in place. Turzillo, U.S. Pat. No. 3,354,657 shows a similar system.

Langenbach Jr., U.S. Pat. No. 4,678,373 discloses a method for supporting a structure in which a piling beating a footing structure is driven down into the ground by pressing from above with a large hydraulic ram anchored to the structure. The void cleared by the footing structure may optionally be filled by pumping concrete into the void through a channel inside the pile. The ram used to insert the Langenbach Jr. piling is large, heavy and expensive.

Another approach to placing piles is to insert a hollow form in the ground with the piles desired and then to fill the hollow form with fluid cement. Hollow forms may be driven into the ground by impact or screwed into the ground. This approach is cumbersome because the hollow forms are unwieldy and expensive. Examples of this approach are described in U.S. Pat. Nos. 2,326,872 and 2,926,500.

Helical pier systems, such as the CHANCE™ helical pier system available from the A. B. Chance Company of Centralia Mo. U.S.A., provide an attractive alternative to the systems described above. As described in more detail below, the CHANCE helical pier system includes a helical screw mounted at the end of a shaft. The shaft is tamed to draw the helical screw downwardly into a body of soil. The screw is screwed downwardly until the screw is seated in a region of soil sufficiently strong to support the weight which will be placed on the pier.

Brackets may be mounted on the upper end of the pier to support the foundation of a building. Helical pier systems have the advantages that they are relatively inexpensive to use and are relatively easy to install in tight quarters. Helical pier systems have two primary disadvantages. Firstly, they rely upon the surrounding soil to support the shaft and to prevent the shaft from bending. In situation where the surrounding soil is very weak the surrounding soil cannot provide the necessary support. Consequently, helical piers can bend in such situations. A second disadvantage of helical piers is that the metal components of the piers are in direct contact with the surrounding soil. Consequently, if the shaft passes through regions in the soil which are highly chemically active then the shaft may be eroded, thereby weakening the pier.

SUMMARY OF THE INVENTION

This invention provides a method for forming a pile which overcomes some disadvantages of prior art helical piers. The method comprises the steps of: providing a screw pier comprising a shaft having a screw at one end thereof and a soil displacement means on the shaft spaced apart from the screw; placing the screw in soil and turning the shaft to draw the screw downwardly into the soil; providing a bath of grout around the shaft; continuing to mm the shaft to draw the soil displacement means downwardly through the soil, thereby forcing the soil out of a cylindrical region surrounding the shaft; allowing grout from the bath to flow into the cylindrical region; and, allowing the grout to solidify, thereby encasing the shaft. The soil displacement means has a diameter smaller than a diameter of the screw and preferably comprises a disk extending in a plane generally perpendicular to the shaft.

A second aspect of the invention provides a method for forming a pile. The method comprises the steps of: providing a screw pier comprising a shaft having a screw at one end thereof and soil displacement means on the shaft spaced apart from the screw; placing the screw in soil and turning the shaft to draw the screw downwardly into the soil; continuing to turn the shaft to cause the screw to draw the soil displacement means downwardly through the soil, thereby forcing the soil out of a cylindrical region surrounding the shaft; filling the cylindrical region with grout; and, allowing the grout to solidify, thereby encasing the shaft. The soil displacement means has a diameter smaller than a diameter of the screw and preferably comprises a disk extending in a plane generally perpendicular to the shaft.

A third aspect of the invention provides a screw pier for making a grout encapsulated pile. The pier comprises: an elongated shaft; a screw at one end of the shaft; and a disk on the shaft. The disk projects generally perpendicularly to the shaft, and has a diameter smaller than a diameter of the screw.

BRIEF DESCRIPTION OF THE DRAWINGS

In drawings which illustrate preferred embodiments of the invention, but which should not be construed as restricting the spirit or scope of the invention in any way.

DETAILED DESCRIPTION OF PREFERRED EMBODIMENTS OF THE INVENTION

Prior Art

Figure 1:
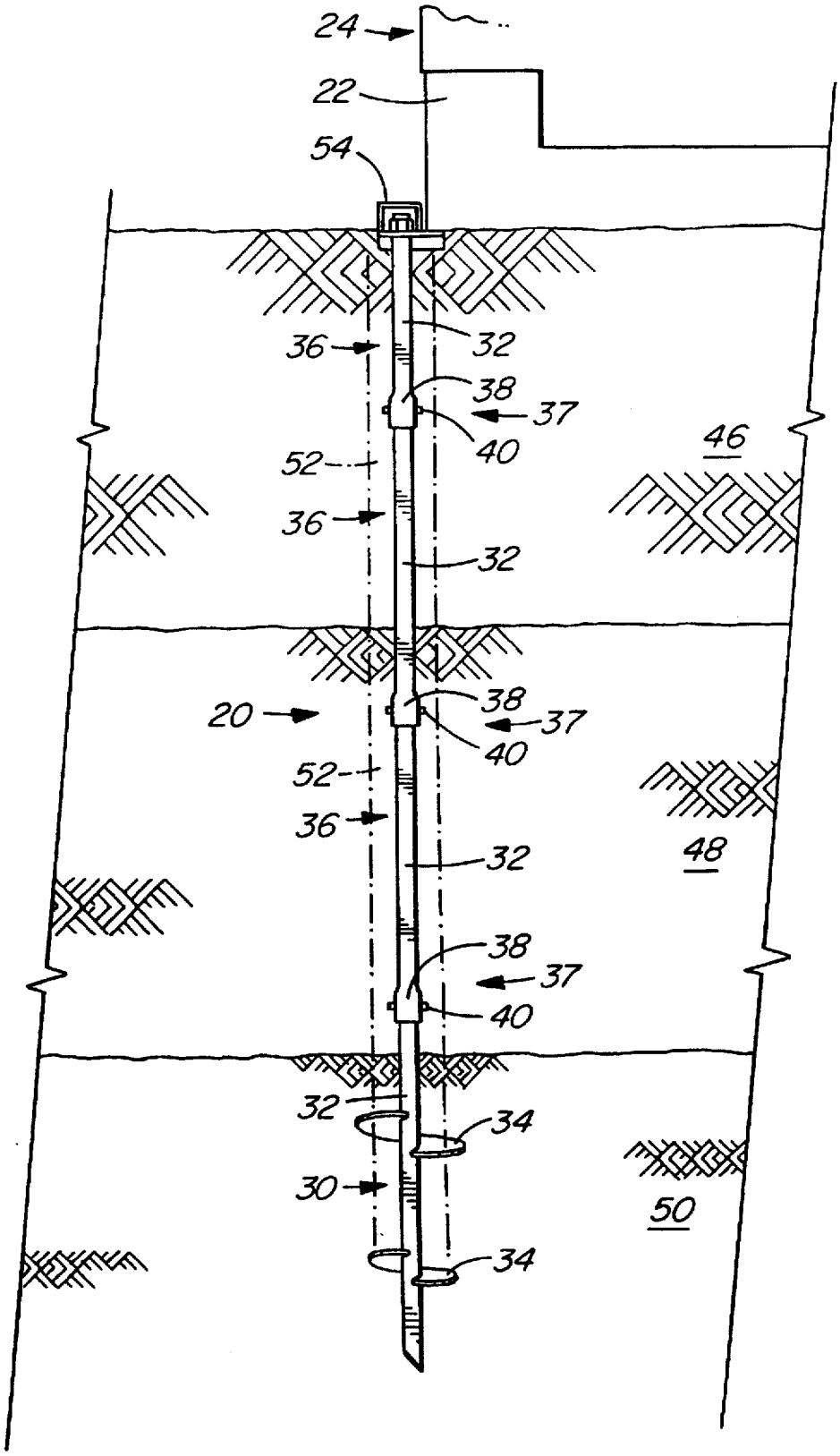
FIG. 1 PRIOR ART
FIG. 1 is an elevational view a prior art helical pier installed in a body of soil and supporting a building foundation.

FIG. 1 shows a prior art helical pier 20 supporting the foundation 22 of a building 24. Helical pier 20 has a lead section 30 which comprises a shaft 32 and a screw 34 mounted to shaft 32. Usually shaft 32 comprises a number of extension sections 36 which are coupled together at joints 37. Each extension section 36 comprises a shaft section 39 and a socket 38. Shaft sections 39 are typically square in section but may, of course have other shapes. Sockets 38 comprise a square recess which fits over the top end of lead section 30 or the top end of the shaft section 39 of a previous one of extension sections 36. Bolts 40 are then used to secure extension sections 36 together. Lead sections are typically available in lengths in the range of 3 feet to 10 feet. While lead section 30 shown in FIG. 1 has only a single helical screw 34 attached to it, a lead section 30 may have two or more screws 34. Additionally, some of extension sections 36 may also be equipped with screws 34.

Helical pier 20 is installed in the body of soil underlying foundation 22 by screwing lead section 30 into the earth adjacent foundation 22 and continuing to turn lead section 30 so that helical screw 34 draws lead section 30 downwardly. As lead section 30 is drawn downwardly extension sections 36 are added as needed. The installation is complete when helical screw 34 has been screwed down into a layer of soil capable of supporting the weight which will be placed on pier 20. In the example of FIG. 1, helical screw 34 was screwed down through two weaker layers of soil 46 and 48 and was received in layer 50. A bracket 54 at the top of helical pier 20 supports foundation 22. Bracket 54 may be equipped with lifting means, as described, for example, in U.S. Pat. Nos. 5,120,163; 5,011,336; 5,139,368; 5,171,107 or 5,213,448 for adjusting the force on the underside of foundation 22.

A problem with the pier shown in FIG. 1 is that the pier can bend, and may even buckle, if the soil in regions 46 and/or 48 is not sufficiently strong to support shaft 32 against lateral motion. This tendency is exacerbated because sockets 38 are somewhat larger in diameter than shaft sections 39. Consequently, as sockets 38 are pulled down through the soil they disturb and further weaken a cylindrical volume 52 of soil immediately surrounding shaft 32. Furthermore, there is generally some clearance between the side faces of shaft sections 39 and the walls of the indentations in sockets 38: Shaft 32 is therefore freely able to bend slightly at each of joints 37. It can be readily appreciated that the force tending to push shafts 32 laterally is increased as shaft 32 becomes bent.

A second problem with the pier shown in FIG. 1 is that it is prone to corrosion. Generally pier 20 will be installed so that screw 34 is in a layer of soil 50 which will not corrode screw 34. In many cases, however, shaft 32 passes through other layers of soil which are more chemically active. In the example shown in FIG. 1, shaft 32 is in direct contact with the soil of layer 48 which may be highly corrosive. In the example shown in FIG. 1, even if screw 34 is imbedded in the layer of soil 50 which is chemically inert, the integrity of the entire pier 20 may be reduced if layer of soil 48 is highly chemically active and erodes the portions of shaft 32 which pass through layer of soil 48.

As an example of the problems which can occur in the use of prior art helical piers, several CHANCE™ SS150–1½" square shaft compression anchors were placed in alluvial soils in Delta, British Columbia, Canada. The shafts were then loaded. It was found that the shafts of the piers failed by buckling when the applied load reached between 25,000 lbs. and 35,000 lbs. To provide a desired 2 to 1 safety factor it was necessary to limit the loading on each such pier to no more than approximately 15,000 lbs per pile. This increased the number of piers needed to support the structure in question.

This Invention

Figure 2:
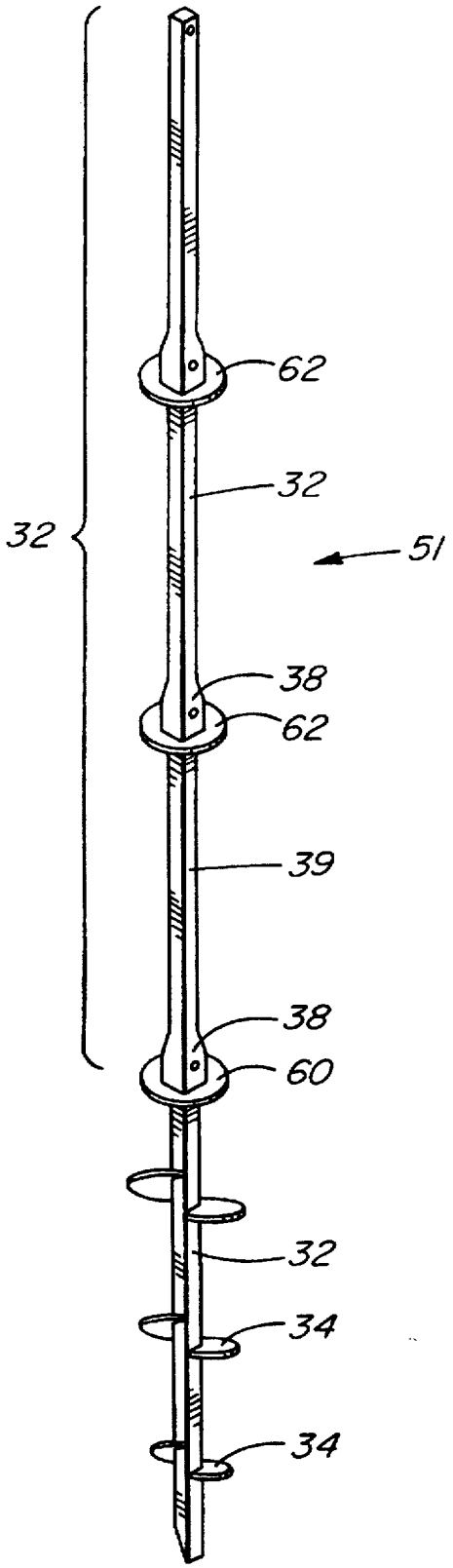
FIG. 2 is a side elevational view of apparatus for practising this invention.

FIG. 2 shows apparatus 51 for practising the method of the invention to make a pile 65 (FIG. 4). Pile 65 may be used to support a structure, which, for clarity, is not shown. Apparatus 51 comprises a helical pier 20, which is preferably a helical pier of the general type described above as shown in FIG. 1 and available from the A. B. Chance Company of Centralia Mo. Other types of helical pier could also be used, as will be readily apparent to those skilled in the art, after reading this specification. Helical pier 20 is modified for practising the invention by the addition of a soil displacing means, which preferably comprises a disk 60 on shaft 32, spaced above screw 34. Disk 60 projects in flange like fashion in a plane generally perpendicular to shaft 32.

Suitable soil displacing means may comprise a section of shaft 32 having an enlarged diameter. For example, sockets 38 may be made large enough to enable them to function as soft displacement means without the necessity of additional parts. In some denser soils, the sockets 38 on prior art helical piers, as described above, may be large enough for use in practising the methods of the invention, although a larger diameter soil displacement means is generally preferred.

Disk 60 may be rigidly held in place on shaft 32 but may also be slidably mounted on shaft 32. Where disk 60 is slidably mounted on shaft 32 it is blocked from moving very far upwardly along shaft 32 by a projection formed by, for example, the lowermost one of sockets 38. Preferably the apparatus includes one or more additional disks 62 which, for most applications, are preferably the same size as disk 60. Disks 62 are not necessarily all the same size and may be larger or smaller than disk 60 as is discussed in more detail below.

The preferred dimensions of disks 60, 62 and screw 34 depend upon the weight to be borne by pile, the properties of the soil in which pile 65 will be placed and the engineering requirements for pile 65. For example, in general: if the soil is very soft then larger disks may be used; if the soil is highly chemically active then larger disks may also be used (to provide a thicker layer of grout to protect the metal portions of the apparatus as described below); and if the soil is harder then smaller disks may be used. Disks 62 are spaced apart from disk 60 along shaft 32.

All of disks 60 and 62 are typically smaller than screw 34. For example, screw 34 is typically in the range of 6 inches to 14 inches in diameter. Shaft sections 39 are typically on the order of 1½" to 2" in thickness and disks 60, 62 are typically in the range of 4 inches to 8 inches in diameter. The preferred size for disks 60 depends upon the weight that will be borne by the pile, the relative softness or hardness of the soil where pile 65 will be placed and on the diameter of screw 34.

Figure 3:
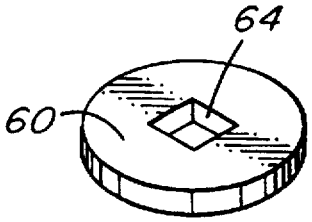
FIG. 3 is a top plan view of a plate for use with the invention.

A disk suitable for use as disk 60, 62 is shown in FIG. 3. Disk 60 may, for example, comprise a circular piece of steel plate thick enough to withstand significant bending as it is used and typically approximately ¼ inch to ⅜ inch in thickness with a hole 64 at its center. Preferably disks 60, 62 are galvanized although this is not necessary. Hole 64 is preferably shaped to conform with the cross sectional shape of shaft 32 so that disk 60 can be slid onto shaft sections 39. Hole 64 is smaller than joints 37. As will be readily appreciated from a full reading of this disclosure, disks 60 and 62 do not necessarily need to be flat but may be curved. Flat disks 60, 62 are generally preferred because they can work well and are less expensive than curved disks.

The method provided by the invention for making and placing a pile 65 is illustrated in FIGS. 4A through 4D. First, shown in FIG. 4A the lead section 30 of a helical pier is turned with a suitable tool 72 so that screw 34 is screwed into the soil at the point where a pile is desired. After screw 34 has screwed into the soil, disk 60 is slipped onto the shaft portion of lead section 30 and a tubular casing 66 is placed around the projecting shaft of lead section 30. The lower edge of tubular casing 66 is embedded in the surface of soil 46. Tubular casing 66 is then partially filled with fluid grout 70 and the level of grout 70 is marked.

Optionally, casing 66 may be placed first at the location where it is desired to place pile 65 and lead section 30 may be introduced downwardly through casing 66 and screwed into the soil inside casing 66 either before or after grout 70 has been introduced into casing 66. Where lead section 30 is started after grout 70 has been placed in casing 66 then grout 70 may lubricate screw 34 and thereby reduce the torque needed to start screw 34 into the soil beneath casing 66.

Tubular casing 66 typically and conveniently comprises a round cardboard form approximately 24" high and approximately 18" in diameter. However, casing 66 may be any form capable of holding a bath of fluid grout 70 and large enough to pass disks 62. It is not necessary that casing 66 be round although it is convenient and attractive to make casing 66 round.

In some cases, for example where a pile is being installed through a hole in a cement foundation, it may be unnecessary to provide a separate casing 66 because a suitable bath of fluid grout 70 may be formed and kept in place by pouting fluid grout 70 directly into the hole or an excavation in the soil immediately under the hole.

Figure 4A:
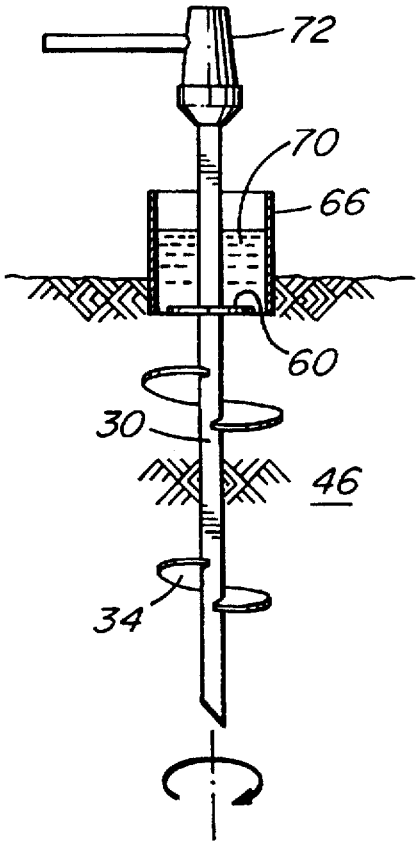
FIGS. 4A, 4B, 4C and 4D are schematic views of steps in practising the method of the invention.
Figure 4B:
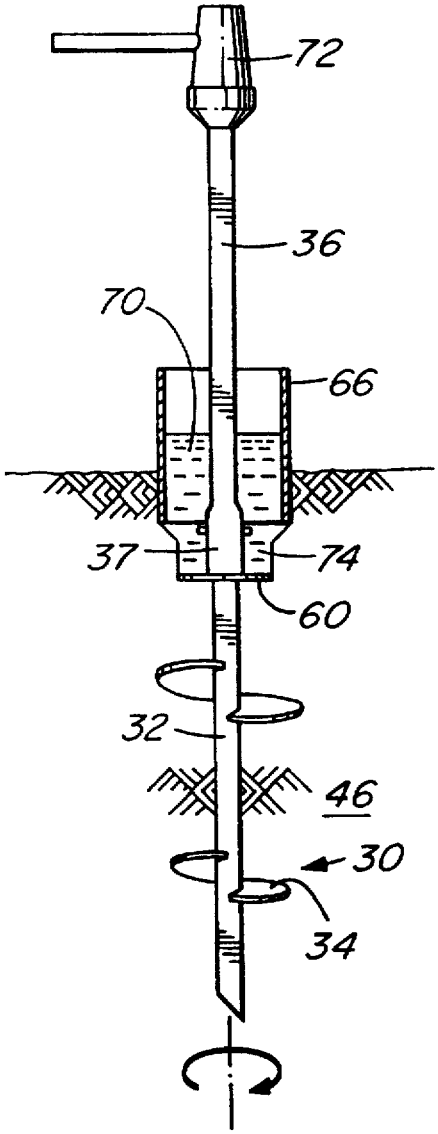

Next, as shown in FIG. 4B, an extension section 36 is attached to lead section 30 and a driving tool is attached to the top of extension section 36 to continue turning shaft 32 and screw 34. Shaft 32 slips through the center of disk 60 until first joint 37 hits disk 60. Subsequently, screw 34 pulls disk 60 down through soil 46. As this happens, grout flows downwardly under the action of gravity from tubular casing 66 into a cylindrical region 74 which disk 60 has cleared of soil.

Disk 60 functions as a soil displacing means which is pulled downwardly by screw 34 to dear cylindrical region 74 of soil. It will readily be apparent to those skilled in the art that various members of different shapes may be attached to shaft 32 in place of disk 60 to displace soil from a generally cylindrical volume surrounding shaft 32 and that such members can therefore function as soil displacing means within the broad scope of this invention.

As disk 60 is pulled downwardly, grout 70 flows into cylindrical region 74 and the level of grout 70 in tubular casing 66 goes down. Tubular casing 66 is periodically refilled with grout. Preferably the amount of grout introduced into tubular casing 66 is measured so that the total amount of grout which flows into cylindrical region 74 may be readily calculated. This information is necessary in some cases to obtain an engineer's approval of pile 65.

Figure 4C:
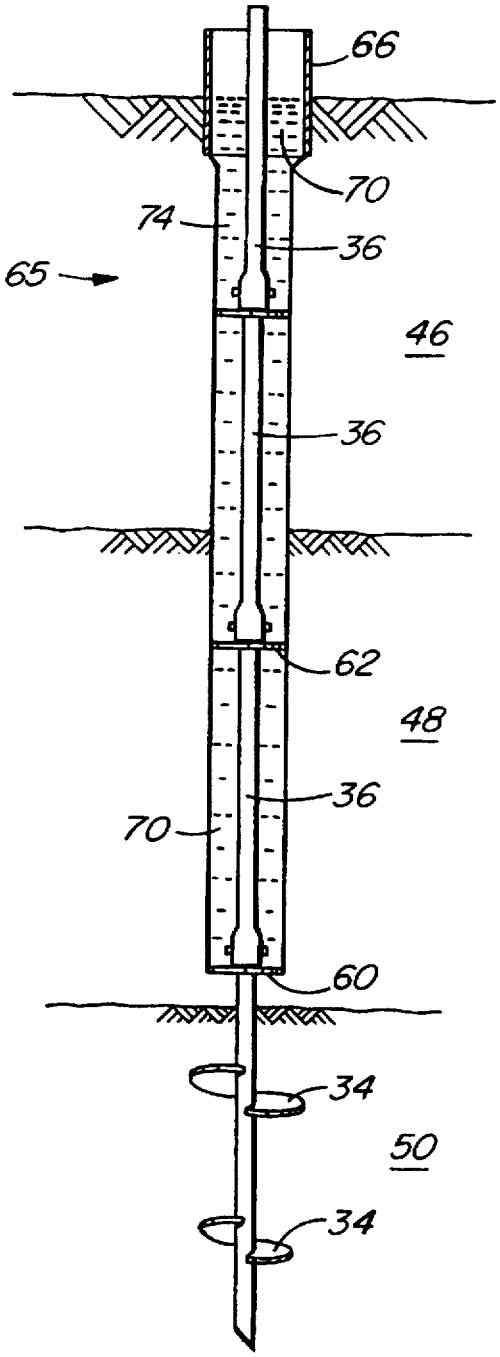
Figure 4D:
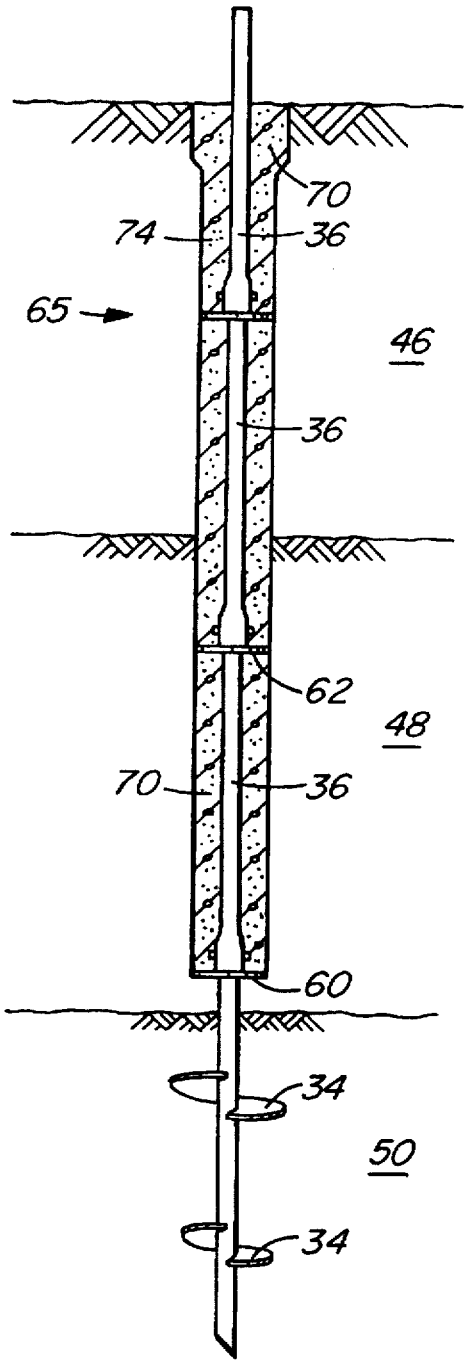

As shown in FIG. 4C, additional disks 62 on additional extension sections 36 are added as screw 34 pulls disks 60 and 62 downwardly through soil 46 until, ultimately, screw 34 is embedded in a stable layer 50 of soil. Disks 62 maintain shaft 32 centered in cylindrical region 74 and may also help to keep soil from collapsing inwardly into cylindrical region 74. In some applications only one or two disks 60, 62 may be necessary. Tubular casing 66 is then removed and grout 70 is allowed to harden. The end result, as shown in FIG. 4D, is that extension sections 36 are encased in a hardened cylindrical column of grout 70. Hardened grout 70 prevents extension section 36 from moving relative to one another and reinforces the portions of shaft 32 above disk 60. Grout 70 also protects shaft 32 from corrosion. The diameter of the column of grout 70 surrounding shaft 32 depends upon the diameter of the soil displacement means (i.e. disk 60 in the embodiment shown in FIG. 4) being used.

As disk 60 is drawn down through soil 46 disk 60 forces soil 46 outwardly and downwardly so that the soil surrounding cylindrical region 74 is somewhat compressed. This helps to retain grout 70 in cylindrical region 74 and also helps to make pile 65 resistant to lateral motion in soil 46 after grout 70 has solidified. The hydrostatic pressure of grout 70 in cylindrical region 74 also helps to keep soft from collapsing inwardly into cylindrical region 74 before grout 70 hardens.

Figure 10:
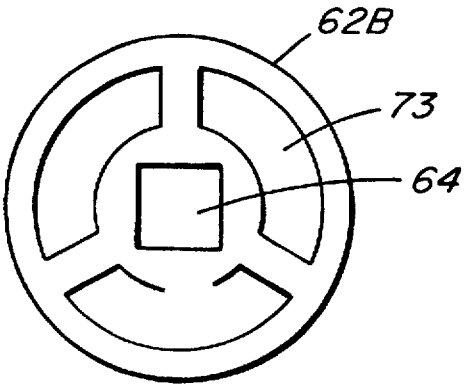

As shown in FIG. 10, disks 62 may be of a type 62C provided with fenestrations 73 so that the column of grout 70 in cylindrical region 74 is not interrupted by disks 62. This allows the full hydrostatic head of fluid grout 70 in cylindrical region 74 to press outwardly against the soil adjacent cylindrical region 74. Where disks 62 are solid, disks 62 may, in some soils, seal against the walls of cylindrical region 74 and isolate portions of cylindrical region 74 between disks 62. If this happens then the hydrostatic pressure of grout 70 in one or more of the isolated portions could be reduced if grout 70 leaked out of that portion into the surrounding soil. This could tend to allow the surrounding soil to collapse into cylindrical region 74.

After grout 70 hardens, the hardened cylindrical column of grout 70 has a diameter similar to the diameter of disk 60, which is significantly larger than the diameter of shaft 32. It therefore takes a larger lateral force to displace pile 65 in soil of a given consistency than would be needed to displace the prior art helical pier 20 shown in FIG. 1. Therefore, pile 65 should have a significantly increased capacity for bearing compressive loads than a prior art helical pier 20 with a similarly sized shaft 32 and screw 34.

Grout 70 is preferably an expandable grout such as the MICROSIL™ anchor grout, available from Ocean Construction Supplies Ltd. of Vancouver British Columbia Canada. This grout has the advantages that it tends to plug small holes and rapidly acquires a high compressive strength during hardening. Another property of this grout is that it resists mixing with water. Preferably grout 70 is fiber reinforced. For example, it has been found that the MICROSIL grout referred to above can usefully be reinforced by mixing it with fibrillated polypropylene fiber, such as the PROMESH™ fibers available from Canada Concrete Inc. of Kitchener, Ontario, Canada according to the fiber manufacturer's instructions. Typically approximately 1.5 pounds of fibers are introduced per cubic yard of grout 70 although this amount may vary.

This invention could be practised in its broadest sense by using for grout 70 any suitable flowable material, such as, for example, cement or concrete, which will firmly set around shaft 32 after it is introduced into cylindrical region 74. Preferably, after it sets, grout 70 seals materials which are embedded in it from contact with any corrosive fluids which may be present in the surrounding soil.

Because shaft 32 is placed in tension as screw 34 pulls disks 60, 62 downwardly through soil 46, it is desirable to compress shaft 32 before grout 70 hardens. After each pile 65 has been placed, and before grout 70 hardens, the projecting end of shaft 32 atop pile 65 is hammered with a heavy hammer, for example, a 16–25 pound sledge. The amount that pile 65 collapses depends upon the amount of play in joints 37. Usually there is approximately ⅛" of play per joint 37 so that for a pile 65 which comprises 5 or 6 extension sections 36 one would expect shaft 32 to collapse by approximately ⅝" to ¾" when it is compressed after placement. The amount of collapse of shaft 32 is preferably measured to verify proper placement of pile 65.

After pile 65 has been placed then it may be attached to a foundation in a manner similar to the way that prior art helical piers 20 are attached to foundations, as discussed above.

In some cases pile 65 will be installed in a place where the topmost layers of soil are very soft. In such cases, additional support may be provided for the uppermost portions of pile 65 by making the uppermost disk or disks 62 significantly larger than disk 60. When screw 34 is in a deeper layer of harder soil then it can pull a relatively large disk 62 downwardly through an overlying layer of softer soil. In some cases, if the surface layers of soil are sufficiently soft, the uppermost one or ones of disks 62 may be even larger in diameter than screw 34.

In prior art driven piles can be difficult to predict where the pile will "bottom out" and it is therefore complicated to design a pile so that the portion of the pile in the topmost layers of soil is, for example, thicker than other portions of the pile. With a pile 65 made according to this invention it is possible to reverse the direction of rotation of screw 34 after screw 34 "bottoms out" to bring the topmost disks 62 to the surface. The removed disks can then be replaced with larger disks and screw 34 can be screwed back into the ground to produce a pile 65 in which the surface portions of the pile have a large diameter. By contrast it is very difficult to pull up a standard driven pile after the pile has been hammered into the ground.

Many variations to the invention are possible without departing from the scope thereof. For example, as described above, soil displacement means for use with the invention may have many shapes, sizes and thicknesses. Screw 34 need not be a helical screw exactly as shown in the prior art but may have other forms. What is particularly important is that screw 34 is capable of drawing a soil displacement means downwardly as screw 34 is turned and that screw 34 is capable of bearing weight when it has been screwed into and is lodged in a hard stable layer of soil.

Figure 6:
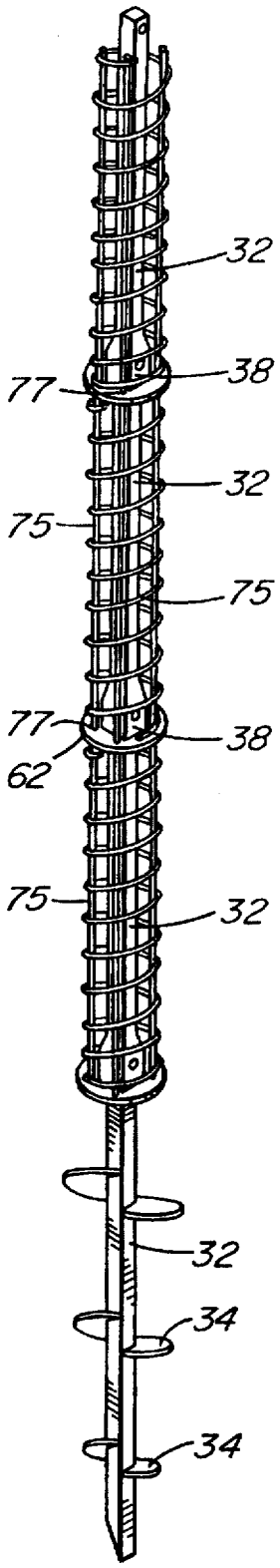
FIG. 6 is a perspective view of a pile made according to the invention reinforced with additional length of reinforcing material.

As shown in FIG. 6, it is possible to reinforce a pile 65 created according to the invention with lengths of reinforcing material 75, such as steel reinforcing bar, which extend through cylindrical region 74. In many applications, reinforcing material 75 may conveniently be 10 to 15 millimeters in diameter although, for some jobs, it may be larger or smaller. For use with lengths of reinforcing material 75 it is preferable that disks 60, 62 have apertures in them through which lengths of reinforcing material 75 can be passed.

Figure 5:
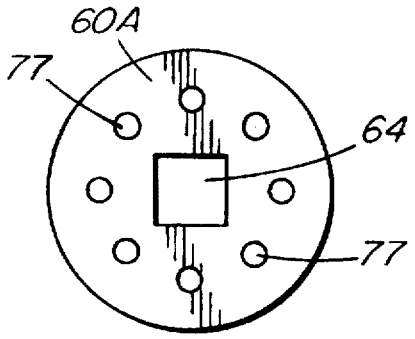
FIG. 5 is a top plan view of an alternative disk for practising the invention.

FIG. 5 shows an alternative disk 60A which has in it a number of apertures 77 for receiving the ends of length of reinforcing material 75. Lengths of reinforcing material 75 are inserted into apertures 77 as disks 60A are drawn down into cylindrical region 74. Each length of reinforcing material 75 extends through an aperture 77 in a disk 60A. Lengths of reinforcing material are made to overlap to meet applicable engineering standards. Apertures 77 hold reinforcing material 75 in place. Lengths of reinforcing material 75 may optionally be welded to disks 60A or 60, 62. Lengths of wire and/or stirrup reinforcements may be used to tie reinforcing material 75 in place during placement and until grout 70 sets.

As shown in FIG. 6, pile 65 may be further reinforced by wrapping one or more additional lengths of reinforcing material 75 around shaft 32 in a spiral inside cylindrical region 74. This is conveniently be done while pile 65 is being installed. A length of reinforcing material 75 can simply be attached to the pile and allowed to wind around the pile as the pile is turned and pulled down into the ground.

Figure 7:
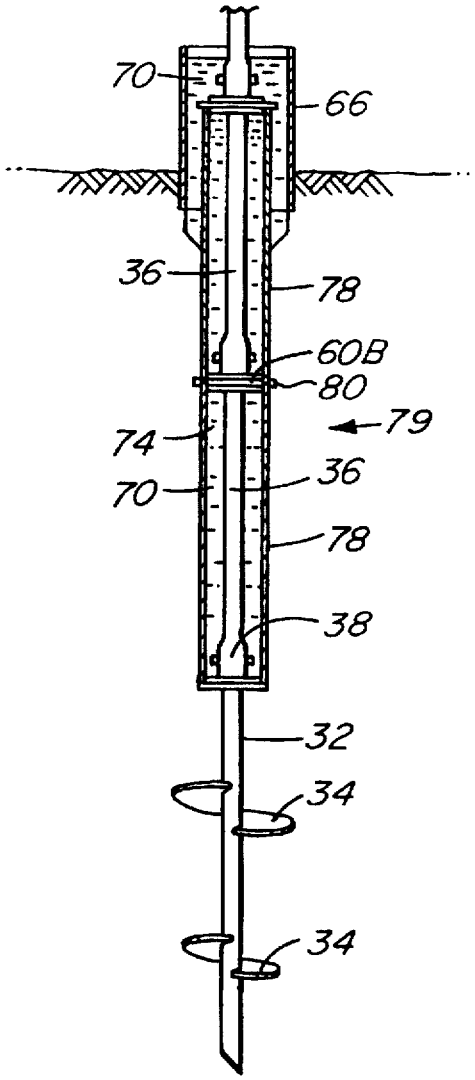
FIG. 7 illustrates the method of the invention being used to manufacture a cased pile.
Figure 8A:
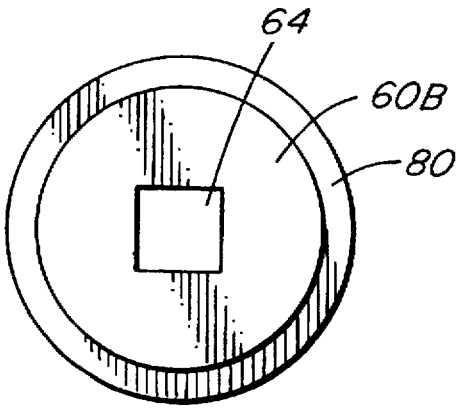
FIGS. 8A and 8B are respectively a top plan view and a side elevational view of a plate for use with the method of the invention for making a cased pile.
Figure 8B:
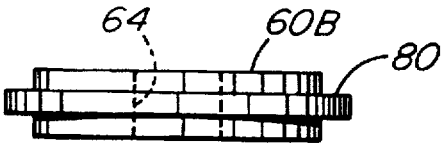

As shown in FIG. 7 and 8, the method of the invention may also be used for making a cased pile 79 which extends inside a tubular casing 78. Where it is desired to make a cased pile 79 it is preferable that disks 60B as shown in FIG. 7 are used. Disks 60B have a flange 80 projecting around their perimeter. Flange 80 is slightly larger in diameter than the exterior diameter of casing 78. The other portions of disks 60B are slightly smaller in diameter than the inner diameter of casing 78. The end of a length of casing 78 is held in contact with flange 80 on disk 60B as disk 60B is pulled into the ground. Casing 78 is dropped into the ground behind disk 60B. Disk 60B keeps casing 78 centered around shaft 32. A separate length of casing 78 is preferably used for each extension section 36 of shaft 32. Casing 78 may comprise, for example, a section of pipe, such as PVC pipe. Casing 78 may be used, for example, where the soil has voids in it into which fluid grout 70 would otherwise escape.

Figure 9:
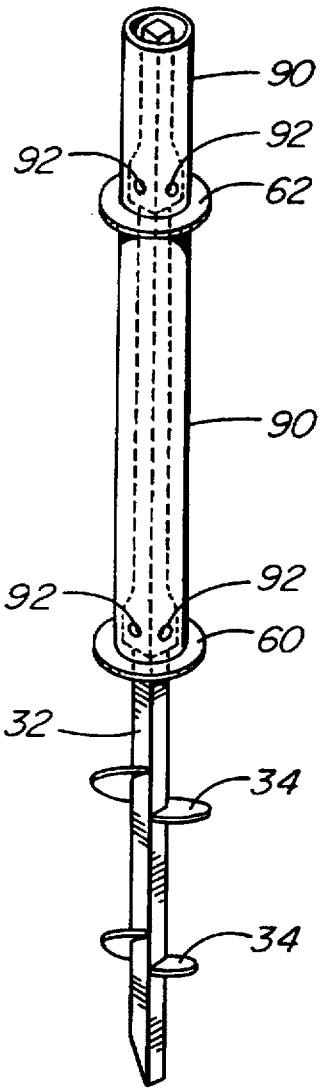
FIG. 9 is a section through an alternative embodiment of the apparatus for practising the invention wherein grout may be introduced through a channel in a central shaft; and, FIG. 10 is a top plan view of a fenestrated disk for use with the invention.

While the methods described above have introduced fluid grout 70 into cylindrical region 74 by feeding grout 70 from a grout bath under the action of gravity, grout 70 may also be introduced into cylindrical region 74 in other ways. For example, as shown in FIG. 9, shaft 32 may have a central tubular passage 90 and at least one, and preferably a number of, apertures 92 extending from tubular passage 90 into cylindrical region 74. Fluid grout 70 may then be pumped downwardly through tubular passage 90 and into cylindrical region 74 through apertures 92 either after screw 34 has been screwed to the desired depth or at a point during the installation of screw 34. In the further alternative, a pipe for pumping fluid grout into cylindrical region 74 may run alongside shaft 32 through suitable apertures in plates 62.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A method for forming a pile, said method comprising the steps of:

(a) providing a screw pier comprising a shaft having a screw at one end thereof and a soil displacing means on said shaft spaced apart from said screw, said soil displacing means having a diameter smaller than a diameter of said screw;

(b) placing said screw in soil and turning said shaft to draw said screw downwardly into the soil;

(c) providing a bath of fluid grout around said shaft;

(d) continuing to turn said shaft to draw said soil displacing means downwardly through the soil, thereby forcing the soil out of a cylindrical region surrounding said shaft;

(e) allowing fluid grout from said bath of fluid grout to flow into said cylindrical region; and, (f) allowing said fluid grout to solidify, thereby encasing said shaft.

2. The method of claim 1 wherein said soil displacing means comprises a disk on said shaft.

3. The method of claim 2 wherein said screw pier comprises a plurality of disks projecting generally perpendicularly to shad shaft at locations spaced apart along said shaft above said soil displacing means.

4. The method of claim 3 wherein all of said plurality of disks have substantially equal diameters.

5. The method of claim 1 wherein said grout comprises a polyfibre reinforced grout.

6. The method of claim 1 further comprising the step of lowering a tubular casing into said cylindrical region immediately behind said soil displacing means.

7. A method for forming a pile, said method comprising the steps of:

(a) providing a screw pier comprising: a shaft having a screw at one end thereof; a soil displacing means comprising a disk on said shaft and spaced apart from said screw; and one or more disks having substantially equal diameters and projecting generally perpendicularly to said shaft at locations spaced apart along said shaft above said soil displacing means, said soil displacing means having a diameter smaller than a diameter of said screw;

(b) placing said screw in soil and turning said shaft to draw said screw downwardly into the soil;

(c) providing a bath of fluid grout around said shaft;

(d) continuing to turn said shaft to draw said soil displacing means downwardly through the soil, thereby forcing the soil out of a cylindrical region surrounding said shaft;

(e) allowing fluid grout from said bath of fluid grout to flow into said cylindrical region; and, (f) allowing said fluid grout to solidify, thereby encasing said shaft;

wherein said bath of fluid grout comprises a quantity of fluid grout in a casing surrounding an upper portion of said shaft, said casing having a lower end in the soil and having a diameter larger than said diameter of said one or more disks.

8. A method for forming a pile, said method comprising the steps of:

(a) providing a screw pier comprising: a shaft having a screw at one end thereof; a soil displacing means comprising a disk on said shaft and spaced apart from said screw; and one or more disks having substantially equal diameters and projecting generally perpendicularly to said shaft at locations spaced apart along said shaft above said soil displacing means, said soil displacing means having a diameter smaller than a diameter of said screw;

(b) placing said screw in soil and turning said shaft to draw said screw downwardly into the soil;

(c) providing a bath of fluid grout around said shaft;

(d) continuing to turn said shaft to draw said soil displacing means downwardly through the soil, thereby forcing the soil out of a cylindrical region surrounding said shaft;

(e) allowing fluid grout from said bath of fluid grout to flow into said cylindrical region; and, (f) allowing said fluid grout to solidify, thereby encasing said shaft; wherein at least some of said one or more disks are apertured around their periphery.

9. A method for forming a pile, said method comprising the steps of:

(a) providing a screw pier comprising: a shaft having a screw at one end thereof; a soil displacing means comprising a disk on said shaft and spaced apart from said screw; and one or more disks having substantially equal diameters and projecting generally perpendicularly to said shaft at locations spaced apart along said shaft above said soil displacing means, said soil displacing means having a diameter smaller than a diameter of said screw;

(b) placing said screw in soil and turning said shaft to draw said screw downwardly into the soil;

(c) providing a bath of fluid grout around said shaft;

(d) continuing to turn said shaft to draw said soil displacing means downwardly through the soil, thereby forcing the soil out of a cylindrical region surrounding said shaft;

(e) allowing fluid grout from said bath of fluid grout to flow into said cylindrical region; and, (f) allowing said fluid grout to solidify, thereby encasing said shaft; further comprising the step of inserting lengths of reinforcing material into apertures in said one or more disks during said step of drawing said soil displacing means downwardly through the soil and allowing said lengths of reinforcing material to be drawn downwardly into said cylindrical region.

10. The method of claim 9 wherein said lengths of reinforcing material overlap in spaces between adjacent ones of said one or more disks.

11. The method of claim 9 further comprising the step of winding a length of reinforcing material in a spiral around said shaft thereby forming a spiral of reinforcing material which is drawn downwardly into said cylindrical region with said soil displacement means.

12. The method of claim 11 wherein said step of winding a length of reinforcing material in a spiral around said shaft comprises winding a length of reinforcing material in a spiral around said shaft as said shaft is turned.

13. The method of claim 9 wherein said reinforcing material comprises steel reinforcing bar.

14. The method of claim 13 wherein, after said step of allowing said grout to solidify, said reinforcing bar is completely encased in said grout.

15. The method of claim 14 wherein said grout comprises a polyfibre reinforced grout.

16. A method for forming a pile, said method comprising the steps of;

(a) providing a screw pier comprising; a shaft having a screw at one end thereof; a soil displacing means comprising a disk on said shaft and spaced apart from said screw; and one or more disks having substantially equal diameters and projecting generally perpendicularly to said shaft at locations spaced apart along said shaft above said soil displacing means, said soil displacing means having a diameter smaller than a diameter of said screw;

(b) placing said screw in soil and turning said shaft to draw said screw downwardly into the soil;

(c) providing a bath of fluid grout around said shaft;

(d) continuing to turn said shaft to draw said soil displacing means downwardly through the soil, thereby forcing the soil out of a cylindrical region surrounding said shaft;

(e) allowing fluid grout from said bath of fluid grout to flow into said cylindrical region; and, (f) allowing said fluid grout to solidify, thereby encasing said shaft; further comprising the step of winding a length of reinforcing material in a spiral around said shaft as said shaft is turned, thereby forming a spiral of reinforcing material which is drawn downwardly into said cylindrical region with said soil displacement means.

17. A method for forming a pile, said method comprising the steps of:

(a) providing a screw pier comprising a shaft having a screw at a lower end thereof and soil displacing means on said shaft above said screw and spaced apart from said screw, said soil displacing means having a diameter smaller than a diameter of said screw;

(b) placing said screw in soil and turning said shaft to draw said screw downwardly into the soil;

(c) continuing to turn said shaft to cause said screw to draw said soil displacing means downwardly through the soil, thereby forcing the soil out of a cylindrical region surrounding said shaft;

(d) filling said cylindrical region with fluid grout during or after said step of drawing said soil displacing means downwardly through the soil; and, (e) allowing said grout to solidify, thereby encasing said shaft in a column of solidified grout.

18. The method of claim 17 wherein said soil displacing means comprises a disk on said shaft, said disk extending in a plane generally perpendicular to said shaft.

19. The method of claim 18 wherein said step of filling said cylindrical region with fluid grout comprises forcing said fluid grout through a tubular passage in said shaft and into said cylindrical cavity through at least one aperture in a wall of said shaft.

20. The method of claim 19 wherein said screw pier comprises a plurality of said disks at spaced apart locations along said shaft and said fluid grout is forced into said cylindrical region through at least one aperture between each pair of adjacent disks.

21. The method of claim 17, wherein said shaft of said screw pier comprises a plurality of sections and said step of turning said shaft to draw said disk downwardly through the soil comprises adding sections at a top end of said shaft as said shaft is drawn downwardly.

22. The method of claim 17 wherein said step of filling said cylindrical region with grout comprises providing a pipe extending into said cylindrical region and pumping fluid grout through said pipe.

23. A method for forming a pile, said method comprising the steps of:

(a) providing a screw pier comprising a shaft having a screw at a lower end thereof and soil displacing means on said shaft above said screw and spaced apart from said screw, said soil displacing means having a diameter smaller than a diameter of said screw;

(b) placing said screw in soil and turning said shaft to draw said screw downwardly into the soil;

(c) continuing to turn said shaft to cause said screw to draw said soil displacing means downwardly through the soil, thereby forcing the soil out of a cylindrical region surrounding said shaft;

(d) filling said cylindrical region with fluid grout during or after said step of drawing said soil displacing means downwardly through the soil; and, (e) allowing said grout to solidify, thereby encasing said shaft in a column of solidified grout wherein said step of filling said cylindrical region with grout comprises surrounding said shaft with a bath of grout at a point where said shaft enters the soil and allowing said grout to flow into said cylindrical cavity behind said soil displacement means as said soil displacement means is drawn downwardly through the soil by said screw.

24. The method of claim 23 wherein said soil displacing means comprises a disk on said shaft, said disk extending in a plane generally perpendicular to said shaft.

25. The method of claim 24 wherein said bath of grout has a diameter larger than said disk.

26. The method of claim 25 wherein said screw pier comprises a plurality of disks on said shaft and said step of filling said cylindrical region with grout comprises drawing said disks downwardly through said bath of grout by turning said screw.

27. The method of claim 26 comprising the step of replenishing said grout bath with measured volumes of said grout as said disk is drawn downwardly through the soil.

28. The method of claim 24 further comprising the step of lowering a tubular casing into said cylindrical region immediately behind said disk.

29. The method of claim 28 wherein said disk has a flange of diameter greater than said tubular casing projecting from an edge of said disk and said tubular casing is lowered in contact with said flange.

30. The method of claim 23 wherein said soil displacing means comprises a disk on said shaft, said disk extending in a plane generally perpendicular to said shaft, said bath of grout has a diameter larger than said disk and wherein, as said soil displacement means is drawn downwardly through the soil by said screw, said grout in said cylindrical region is maintained in fluid communication with said grout in said grout bath so that a hydrostatic pressure of said grout in said cylindrical region is sufficiently high to resist motion of the soil into said cylindrical region.

31. A method for forming a pile, said method comprising the steps of:

(a) providing a screw pier comprising a shaft having a screw at a lower end thereof and soil displacing means on said shaft above said screw and spaced apart from said screw, said soil displacing means having a diameter smaller than a diameter of said screw;

(b) placing said screw in Boil and turning said shaft to draw said screw downwardly into the soil;

(c) continuing to turn said shaft to cause said screw to draw said soil displacing means downwardly through the soil, thereby forcing the soil out of a cylindrical region surrounding said shaft;

(d) filling said cylindrical region with fluid grout during or after said step of drawing said soil displacing means downwardly through the soil; and, (e) allowing said grout to solidify, thereby encasing said shaft in a column of solidified grout wherein said shaft of said screw pier comprises a plurality of sections and said step of turning said shaft to draw said soil displacing means downwardly through the soil comprises adding sections at a top end of said shaft as said shaft is drawn downwardly and joints between said shaft sections are larger in diameter than sections of said shaft intermediate said joints and said step of adding sections to said shaft comprises sliding disks onto said shaft below said joints.

32. A method for forming a pile, said method comprising the steps of:

(a) providing a screw pier comprising a shaft having a screw at a lower end thereof and soil displacing means on said shaft above said screw and spaced apart from said screw, said soil displacing means having a diameter smaller than a diameter of said screw;

(b) placing said screw in soil and turning said shaft to draw said screw downwardly into the soil;

(c) continuing to turn said shaft to cause said screw to draw said soil displacing means downwardly through the soil, thereby forcing the soil out of a cylindrical region surrounding said shaft;

(d) filling said cylindrical region with fluid grout during or after said step of drawing said soil displacing means downwardly through the soil; and, (e) allowing said grout to solidify, thereby encasing said shaft in a column of solidified grout;

wherein said step of filling said cylindrical region with grout comprises providing a pipe extending into said cylindrical region and pumping fluid grout through said pipe and said pipe extends through an aperture in at least one disk on said shaft above said soil displacing means, said at least one disk extending in a plane generally perpendicular to said shaft.

33. A screw pier for making a grout encased pile, said pier comprising:

(a) an elongated shaft;

(b) a screw at a first end of said shaft; and (c) a generally planar disk on said shaft, said disk projecting generally perpendicularly to said shaft, said disk having a diameter smaller than a diameter of said screw.

34. The screw pier of claim 33 comprising a plurality of generally parallel generally planar disks at spaced apart locations along said shaft.

35. A screw pier for making a grout encased pile, said pier comprising:

(a) an elongated shaft;

(b) a screw at a first end of said shaft;

(c) a disk on said shaft, said disk projecting, generally perpendicularly to said shaft, said disk having a diameter smaller than a diameter of said screw; and (d) a plurality of generally parallel disks at spaced apart locations along said shaft wherein said shaft comprises a plurality of sections connected by joints, said joints between said shaft sections are larger in diameter than intermediate portions of said shaft intermediate said joints and said disks are slidably mounted on said intermediate portions between pairs of said joints.

36. A screw pier for making a grout encased pile, said pier comprising:

(a) an elongated shaft;

(b) a screw at a first end of said shaft;

(c) a disk on said shaft, said disk projecting generally perpendicularly to said shaft, said disk having a diameter smaller than a diameter of said screw; and (d) a plurality of generally parallel disks at spaced apart locations along said shaft wherein one or more of said disks nearest a second end of said shaft are fenestrated.

37. A screw pier for making a grout encased pile, said pier comprising:

(a) an elongated shaft;

(b) a screw at a first end of said shaft;

(c) a soil displacement disk on said shaft, said soil displacement disk projecting generally perpendicularly to said shaft, said soil displacement disk having a diameter smaller than a diameter of said screw; and (d) a plurality of generally parallel disks at spaced apart locations along said shaft;

wherein said shaft comprises a plurality of sections connected by joints and said plurality of generally parallel disks are each mounted on one of said intermediate portions between a pair of said joints.

* * * * *